US010151305B2

(12) United States Patent
Erlinger et al.

(10) Patent No.: US 10,151,305 B2
(45) Date of Patent: Dec. 11, 2018

(54) BENT-AXIS MACHINE HAVING MINIMUM NON-ZERO PIVOT ANGLE

(71) Applicant: Wacker Neuson Linz GmbH, Horsching (AT)

(72) Inventors: Josef Erlinger, St. Veit im Muhlkreis (AT); Harald Thumfart, Herzogsdorf (AT); Robert Finzel, Leonding (AT)

(73) Assignee: Wacker Neuson Linz GmbH, Horsching (AT)

( * ) Notice: Subject to any disclaimer, the term of this patent is extended or adjusted under 35 U.S.C. 154(b) by 481 days.

(21) Appl. No.: 14/652,504

(22) PCT Filed: Dec. 17, 2013

(86) PCT No.: PCT/AT2013/050254

§ 371 (c)(1),
(2) Date: Jun. 16, 2015

(87) PCT Pub. No.: WO2014/094024

PCT Pub. Date: Jun. 26, 2014

(65) Prior Publication Data

US 2015/0345483 A1 Dec. 3, 2015

(30) Foreign Application Priority Data

Dec. 18, 2012 (AT) ..... A 50597/2012

(51) Int. Cl.
*F04B 1/32* (2006.01)
*F04B 1/20* (2006.01)
(Continued)

(52) U.S. Cl.
CPC ..... *F04B 1/328* (2013.01); *F03C 1/0642* (2013.01); *F03C 1/0694* (2013.01); *F04B 1/2064* (2013.01); *F04B 1/24* (2013.01)

(58) Field of Classification Search
CPC .... F04B 1/24; F04B 1/32; F04B 1/328; F04B 1/2021; F04B 1/2064; F04B 1/324; F03C 1/0636; F03C 1/0694; F03C 1/0642
See application file for complete search history.

(56) References Cited

U.S. PATENT DOCUMENTS 2,382,437 A * 8/1945 Hans ..... F01B 3/02 417/218
4,034,652 A * 7/1977 Huebner ..... F04B 1/2042 91/499

(Continued)

FOREIGN PATENT DOCUMENTS

DE 10 2008 062 295 A1 6/2010
DE 10 2011 075 077 A1 11/2012

(Continued)

*Primary Examiner* — Bryan Lettman
*Assistant Examiner* — Timothy P Solak
(74) *Attorney, Agent, or Firm* — Boyle Fredrickson, S.C.

(57) ABSTRACT

A bent-axis machine comprises a housing having a control cover and a piston drum which is rotatably mounted in the housing on a valve plate and which has axial cylinders, each of which receives a piston. An adjustment system includes a pivot cradle via which the piston drum and the valve plate can be pivoted relative to the drive axis about a maximum working range which is delimited by a minimum pivot angle and a maximum pivot angle. The minimum pivot angle of the working range is shifted out of its zero position by at least 5°, and the maximum pivot angle is extended in the same way by at least 5° in order to retain the entire working range about the region left out of the lower region.

7 Claims, 1 Drawing Sheet

(51) Int. Cl.

| | |
|---|---|
| ***F04B 1/24*** | (2006.01) |
| ***F03C 1/06*** | (2006.01) |
| ***F03C 1/40*** | (2006.01) |

(56) References Cited

U.S. PATENT DOCUMENTS

| | | | | |
|---|---|---|---|---|
| 5,231,912 | A * | 8/1993 | Akasaka | F04B 1/2085 91/499 |
| 5,473,895 | A | 12/1995 | Bausenhart et al. | |
| 5,488,894 | A * | 2/1996 | Schroder | F04B 1/24 91/505 |
| 8,156,738 | B2 * | 4/2012 | Gollner | F16H 39/08 60/492 |
| 2002/0066364 | A1 * | 6/2002 | Skirde | F04B 1/324 92/71 |
| 2006/0021813 | A1 * | 2/2006 | Gray, Jr. | B60K 6/12 180/165 |
| 2006/0110265 | A1 | 5/2006 | Lanfredi et al. | |
| 2007/0281815 | A1 | 12/2007 | Gollner | |
| 2009/0013863 | A1 * | 1/2009 | Bianchi | F04B 1/2064 92/12.2 |

FOREIGN PATENT DOCUMENTS

| | | | | |
|---|---|---|---|---|
| EP | 0 409 084 A2 | | 7/1991 | |
| EP | 0 728 945 | * | 8/1996 | F04B 1/20 |

* cited by examiner

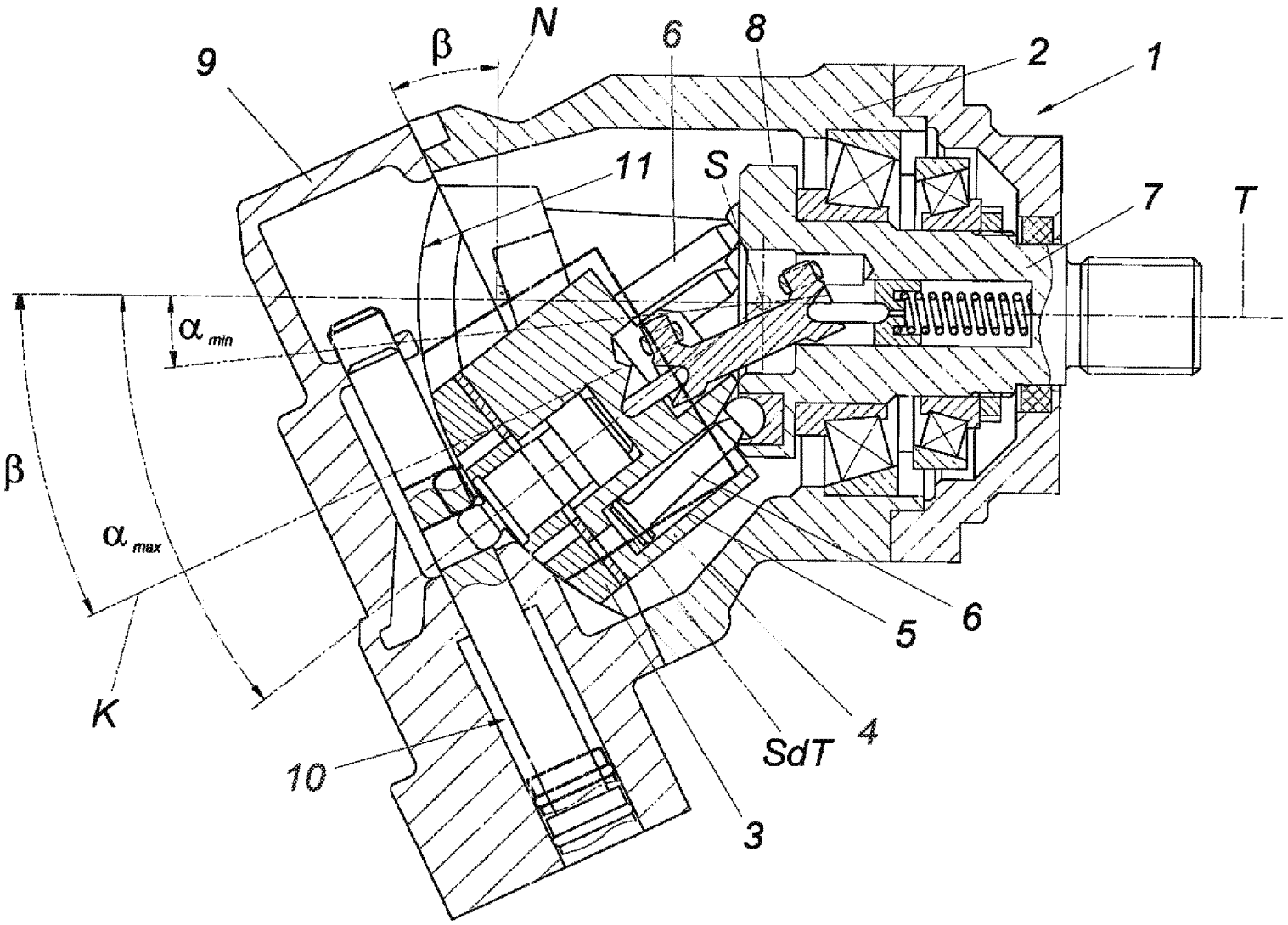
T
1
7
2
6
5
4
SdT
3
8
S
6
11
N
β
9
10
$\alpha_{min}$
$\alpha_{max}$
K
β

BENT-AXIS MACHINE HAVING MINIMUM NON-ZERO PIVOT ANGLE

BACKGROUND OF THE INVENTION

1. Field of the Invention

The present invention relates to a bent-axis machine that includes a housing having a control cover and a piston drum, rotatably mounted in the housing on a valve plate, having axial cylinders, of which each cylinder accepts a piston, having a drive flange allocated to a drive shaft, on which flange the free ends of the pistons protruding from the cylinders are supported, and having an adjustment system including a pivot cradle for adjusting the displacement volume, having an actuating drive with which the piston drum with the valve plate can be pivoted by a maximum operating range relative to the drive axis, the range being limited by a minimum and a maximum angle of rotation, and a hydraulic fluid guiding via the pivot cradle taking place through the valve plate.

2. Discussion of the Related Art

Bent-axis machines in the sense of the present invention are hydraulic machines that, as axial piston pumps, are used to convert mechanical energy, i.e. torque or rotational speed, into hydraulic energy, i.e. volume flow or pressure, or, as axial piston motors, are used to convert hydraulic energy (volume flow or pressure) into mechanical energy (torque or rotational speed). Bent-axis machines of this type are known for example from EP 0 728 945 A1 and from EP 0 409 084 A2. Bent-axis machines are standardly fashioned in such a way that the piston drum in the control cover (the housing head) can be pivoted, with an actuating drive, between a minimum pivot angle of approximately 0° and a maximum pivot angle of up to 32 or 33°, this region being fashioned as a pivot cradle. The supplying of the piston pump, namely the intake duct and the pressure duct, are here guided via, or through, the stated pivot cradle. The range by which the piston drum can be pivoted between the minimum and maximum pivot angle in the housing is limited by the design, and is determined in particular by the control plate (valve plate) guided in the pivot cradle in the control cover, which, when the minimum pivot angle is fallen below, or when the maximum pivot angle is exceeded, no longer allows a properly functioning supply and carrying off of hydraulic fluid through the control cover. In particular, when these limits are exceeded hydraulic fluid escapes from the flow channels between the control cover and valve plate into the housing, so that the reliable functioning of the machine is no longer ensured.

As long as a pivot angle of 0° is set, i.e. the drive shaft axis and the piston drum axis coincide, the bent-axis machine does not convey any volume flow; that is, in this operating state the machine has practically no displacement volume. If the piston drum with the pistons is pivoted in the direction of the maximum pivot angle, i.e. the pistons are pivoted out to the side, then during the rotational movement the pistons, triggered by the oblique positioning of the piston drum on the inner side of the bend, move deeper into the cylinder, and on the outer side of the bend move out of the cylinder in the direction of bottom dead center. When there is a rotation, the pistons are alternately pulled out of the cylinder, or pressed into the cylinder, through the connection with the drive flange. In this way, when the pistons are pulled away from the control plate there arises a partial vacuum in the cylinders that suctions the hydraulic fluid into the cylinder via the pivot cradle. On the other side, when the pistons are displaced toward the control plate there arises an excess pressure that drives hydraulic fluid out of the cylinder and out of the hydraulic aggregate via the pivot cradle.

Such bent-axis machines can be mass-produced relatively inexpensively. However, as already mentioned, the maximum range of adjustment is limited by the design. If, as a result of conditions of use, a larger range of adjustment is to be covered or is required, then bent-axis machines having yoke adjustment must be used, i.e. hydraulic aggregates that permit a range of adjustment of from 0° to 45°. In these machines, whose design requires a large outlay and which are therefore very expensive, the housing is divided into two or more parts, and the housing casing, enclosing the piston drum, is capable of being pivoted relative to the housing part that accommodates the drive shaft. Precisely this design requires significant additional design outlay and monetary expense, and for this reason bent-axis machines having yoke adjustment are not available for traction drives in the low-cost segment.

US 2006/0110265 A1 discloses a swash plate machine that is used in particular as a pump unit for high-pressure cleaners. The stated swash plate machine relates only to a conveyor pump that functions purely passively, in which the conveying pressure is set automatically as a function of the conveyed volume, via passive elements, in particular elastomer elements.

SUMMARY OF THE INVENTION

Based on the existing art as described above, the present invention is based on the object of providing a bent-axis machine of the type described above that can provide a significantly larger displacement volume or conveyed volume with a low design outlay, without having to make use of a bent-axis machine having an adjustable yoke.

The present invention achieves this object in that the minimum pivot angle of the operating range is shifted from its zero position by at least 5°, preferably by at least 7°, the maximum pivot angle being supplemented, in order to maintain the full operating range, by the range left out in the lower region, likewise by at least 5°, preferably by at least 7°.

In this way, according to the present invention it is provided that a bent-axis machine is realized in such a way that the lower range is completely left out from 0° to 5°, in particular up to 7°, and is not available for use. It has turned out that in practical use this range cannot be used in many applications, because, in particular given use as a hydraulic motor, only an inadequate degree of efficiency is present in this range. For various possible uses, for example in the drive trains of construction machines, various other hydraulic drives, or the like, the maximum displacement volume is however also important, which can be increased by the displacement according to the present invention of the overall operating range. The present invention fundamentally provides that the lower region is not used, i.e. is left out, and instead the upper range is supplemented by the amount left out in the lower range. Because the angular difference between the maximum and minimum pivot angle is limited by the design, according to the present invention the entire operating range is shifted "upward" in order to make the full operating range, or pivot range, usable without limitation, so that the maximum pivot angle that can be effectively used during operation is significantly expanded in comparison with the existing art.

The maximum pivot angle limited by the control plate is at least 37°, preferably at least 39°. This measure according to the present invention results in an increase in the maximum displacement volume by a significant amount, which significantly increases the spectrum of use of such bent-axis machines at least for certain applications, for example for traction drives.

In order to make it possible to use the present invention in bent-axis machines in practice, of course the guide that accommodates the control plate must be made in correspondingly "shifted" fashion. In this way, the theoretical adjustment ranges available for a traction drive can also be fully exploited, in contrast to the existing art.

Particularly simple designs result if the control cover that forms a guide for the valve plate is placed onto the housing with an angle of inclination of at least 21°, this angle of inclination being present between a drive shaft normal and the contact surfaces between the housing and the housing head, inclined by the piston drum pivot axis. Thus, according to the present invention it is provided to place the housing head, already placed on the housing with an inclination, onto the housing with a greater inclination, to leave out the lowest pivot angle region, and to append it to the uppermost pivot angle range. A control cover connecting surface normal of the control cover is here inclined relative to the drive shaft axis by an angle of inclination that is equal to half the sum of the maximum and minimum pivot angle ($\beta=(\alpha_{max}+\alpha_{min})/2$), where $\beta$ is greater than or equal to 21°.

The present invention also relates to a traction drive for a mobile working machine having at least one hydraulic pump and having at least one hydraulic motor, at least one of the two hydraulic aggregates being fashioned as a bent-axis machine as recited in one of Claims 1 through 3.

BRIEF DESCRIPTION OF THE DRAWING

In the drawing, the present invention is shown schematically on the basis of an exemplary embodiment.

FIG. 1 shows a longitudinal section through a bent-axis machine according to the present invention.

DETAILED DESCRIPTION

A bent-axis machine 1 for a traction drive according to the present invention includes, inter alia, a housing 2, a piston drum 4 rotatably mounted in housing 2 on a valve plate 3, having axial cylinders 5, of which each cylinder 5 accepts a piston 6. In addition, a drive flange 8 is provided that is allocated to a drive shaft 7. on which flange the free ends of pistons 6 protruding from cylinders 5 are supported. Piston drum 4 and valve plate 3, guided in particular in control cover 9, are pivotable in housing 2 in order to adjust the displacement volume with an actuating drive 10 relative to drive axis T, by a maximum operating range that is limited by a minimum pivot angle $\alpha_{min}$ and a maximum pivot angle $\alpha_{max}$. The adjustment system for adjusting the displacement volume with actuating drive 10 includes a pivot cradle, essentially valve plate 3 and the allocated pivot guide in control cover 9. Hydraulic fluid is guided via the pivot cradle.

According to the present invention, the minimum pivot angle ($\alpha_{min}$) of the operating range is shifted, while maintaining the full operating range, from its zero position by at least 5°, preferably by at least 7°. The maximum pivot angle $\alpha_{max}$ limited by valve plate 3 is at least 37°, preferably at least 39°.

In the design of the present invention according to the exemplary embodiment, a control cover connecting surface normal K of control cover 9 is inclined relative to drive shaft axis T by an angle of inclination $\beta$ that is equal to half the sum of the maximum and minimum pivot angle, $\beta=(\alpha_{max}+\alpha_{min})/2$, where $\beta$ is greater than or equal to 21°.

The lower region of from 0° to 5°, in particular up to 7°, is no longer available for use. The overall maximum operating range available for use is shifted "upward" in order to make the complete operating range or pivot range usable without limitation.

The invention claimed is:

1. A bent-axis machine comprising:

a housing having a control cover;

a valve plate;

a piston drum rotatably mounted in the housing on the valve plate, the piston drum having axial cylinders, a piston located in each cylinder, each piston having a free end protruding from the associated cylinder, and a drive shaft to which is allocated a drive flange and on which are supported the free ends of the pistons; and an adjustment system for adjusting a displacement volume of the piston drum, the adjustment system including a pivot cradle that is configured to be pivoted by an actuating drive so as to pivot the valve plate and the piston drum from a zero position, relative to the drive axis, by a maximum operating range that is limited by a minimum pivot angle ($\alpha_{min}$) and a maximum pivot angle ($\alpha_{max}$), wherein the maximum operating range, including the minimum pivot angle ($\alpha_{min}$) and the maximum pivot angle ($\alpha_{max}$), is shifted by a common amount equaling the shift of the minimum pivot angle ($\alpha_{min}$) from the zero posistion thereof, and wherein, as a result of, the shifting of the operating range from the zero position, a range between the zero position and the minimum pivot angle ($\alpha_{min}$) is not available for use.

2. A bent-axis machine comprising:

a housing having a control cover and a piston drum rotatably mounted in the housing on a valve plate, the piston drum having axial cylinders, each cylinder accepting a piston, having a drive flange allocated to a drive shaft on which free ends of the pistons protruding from the cylinders are supported, and an adjustment system, including a pivot cradle, for adjusting the displacement volume with an actuating drive, with which the piston drum with the valve plate can be pivoted from a zero positon, relative to the drive axis, by a maximum oprating range that is limited by a minimum pivot angle ($\alpha_{min}$) and a maximum pivot angle ($\alpha_{max}$), a guiding of hydraulic fluid taking place via the pivot cradle through the valve plate, wherein the minimum pivot angle ($\alpha_{min}$) of the operating range is shifted from the zero positon thereof by an angle of at least 5° and the maximum pivot angle ($\alpha_{max}$) is shifted by the same angle as the minimum pivot angle($\alpha_{min}$) so that the maximum operating range is shifted by the same amount as the minimum pivot angle ($\alpha_{min}$) is shifted, and wherein, as a result of the shifting of the operating range from the zero position, a range between the zero position and the minimum pivot angle ($\alpha_{min}$) is not available for use.

3. The bent-axis machine as recited in claim 2, wherein the maximum pivot angle ($\alpha_{max}$), is at least 37°.

4. The bent-axis machine as recited in claim 3, wherein the maximum pivot angle ($\alpha_{max}$), is at least 39°.

5. The bent-axis machine as recited in claim 2, wherein a control cover connecting surface normal of the control cover is inclined relative to the drive shaft axis by an angle of inclination (β)that is equal to half the sum of the maximum and minimum pivot angle, $\beta=(\alpha_{max}+\alpha_{min})/2$, where β is greater than or equal to 21°.

6. A traction drive for a mobile working machine having at least one hydraulic pump and at least one hydraulic motor, at least one of which is a bent-axis machine as recited in claim 2.

7. The bent-axis machine as recited in claim 2, wherein the minimum pivot angle ($\alpha_{min}$) of the operating range is shifted from the zero position thereof by at least 7°.

* * * * *